US005857757A

United States Patent [19]

Bieker et al.

[11] Patent Number: 5,857,757

[45] Date of Patent: Jan. 12, 1999

[54] MAXIMUM STORAGE TOOL CHEST

[75] Inventors: Bart K. Bieker; Walter K. Krahenbuhl, both of Algona; Kevin E. McGuire, Bancroft; Adron S. Moen, Emmetsburg; Henry P. Ricke, Algona, all of Iowa

[73] Assignee: Snap-on Tools Company, Kenosha, Wis.

[21] Appl. No.: 723,347

[22] Filed: Sep. 30, 1996

[51] Int. Cl.[6] ..... A47B 91/00

[52] U.S. Cl. ..... 312/351.3; 312/902; 312/350; 312/DIG. 33; 312/330.1; 206/373

[58] Field of Search ..... 206/373, 372, 206/425; 312/330.1, 351.1, 351.3, 351.4, 902, DIG. 33, 249.12, 281, 350, 334.7, 351, 334.14, 334.27

[56] References Cited

U.S. PATENT DOCUMENTS

| | | | |
|---|---|---|---|
| 1,403,883 | 1/1922 | Woods . | |
| 2,156,776 | 5/1939 | Drover . | |
| 2,203,008 | 6/1940 | Bauman . | |
| 2,525,208 | 10/1950 | Clink | 206/373 X |
| 2,599,240 | 6/1952 | Ellerson | 312/334.7 |
| 3,052,363 | 9/1962 | Foote, Jr. et al. | 312/351 X |
| 3,152,698 | 10/1964 | Maddox | 312/350 X |
| 3,321,258 | 5/1967 | MacKay | 312/350 X |
| 3,385,643 | 5/1968 | Adell | 312/351 X |
| 4,120,549 | 10/1978 | Bureau | 312/249.12 X |
| 4,231,626 | 11/1980 | Amtmann et al. | 312/350 |
| 4,303,158 | 12/1981 | Perkins . | |
| 4,436,356 | 3/1984 | Stelling | 312/281 X |
| 4,460,085 | 7/1984 | Jantzen . | |
| 4,643,494 | 2/1987 | Marleau | 312/902 X |
| 4,667,822 | 5/1987 | Coopmans . | |
| 4,765,457 | 8/1988 | Rayhle | 206/372 X |
| 4,780,030 | 10/1988 | Zudall . | |
| 4,782,619 | 11/1988 | Richards | 312/111 X |
| 4,784,382 | 11/1988 | Myers . | |
| 4,811,999 | 3/1989 | Remington et al. | 312/311 |
| 4,844,305 | 7/1989 | McKneely . | |
| 4,915,437 | 4/1990 | Cherry | 312/333 X |
| 4,938,398 | 7/1990 | Hallsen . | |
| 4,976,450 | 12/1990 | Ellefson . | |
| 5,044,059 | 9/1991 | De Giulio | 312/308 X |
| 5,083,664 | 1/1992 | Feng . | |
| 5,114,007 | 5/1992 | Chen | 206/373 |
| 5,192,122 | 3/1993 | Hill | 312/267 |
| 5,213,351 | 5/1993 | Chen | 280/47.19 |
| 5,232,259 | 8/1993 | Booker . | |
| 5,244,265 | 9/1993 | Chiang | 312/902 |
| 5,281,020 | 1/1994 | Romick | 312/308 |
| 5,294,196 | 3/1994 | Chen | 312/263 |
| 5,378,005 | 1/1995 | Norton . | |
| 5,423,651 | 6/1995 | Dinverno | 312/249.11 |
| 5,437,502 | 8/1995 | Warnick et al. | 312/244 |
| 5,439,150 | 8/1995 | Trahms | 312/902 |
| 5,443,311 | 8/1995 | Kadlecek et al. | 312/902 X |
| 5,488,914 | 2/1996 | Ouellette | 109/56 |
| 5,497,878 | 3/1996 | Sandonato | 206/372 X |
| 5,588,659 | 12/1996 | Boes et al. | 312/902 X |

OTHER PUBLICATIONS

Craftsman Power & Hard tools Catalog, pp. 11–12, Mar. 1995.

*Primary Examiner*—Peter M. Cuomo
*Assistant Examiner*—James O. Hansen
*Attorney, Agent, or Firm*—Emrich & Dithmar

[57] ABSTRACT

A tool chest is provided which includes a housing having a top wall, a bottom wall and two substantially parallel side walls. Each side wall connects the top and bottom walls. The bottom wall has an interior surface facing the top wall and an exterior surface facing away from the top wall. The chest also includes a pair of legs connected to the exterior surface of the bottom wall for supporting the housing on a support surface with the bottom wall disposed above the support surface, and a tray slidably supported on the legs. A drawer is supported on drawer supports which are connected to the bottom wall and spaced from the side walls.

21 Claims, 6 Drawing Sheets

MAXIMUM STORAGE TOOL CHEST

BACKGROUND OF THE INVENTION

1. Field of the Invention

This invention relates to storage cabinets, and more particularly, to tool chests.

2. Description of the Prior Art

Tool chests having a plurality of drawers for holding hand tools or other equipment have previously been provided. These chests are portable and can be placed on a support surface such as the top of a roll cabinet or a stationary work surface.

Such chests, however, do not fully utilize the space they occupy for storage purposes. These chests include a housing having a bottom wall. The housing usually has a pair of skids connected to the bottom wall for supporting the housing above a support surface. The skids are usually elongated in a direction perpendicular to the side walls of the housing. The space between the bottom wall and the support surface allows a user to grasp the bottom wall in order to pick the tool chest up and move it to another location. This clearance space under the bottom wall is not available for storage.

For structural integrity, these tool chests also usually include a bottom face plate disposed below the drawers. The face plate rises a certain height above the bottom wall and is connected to both the side walls and the bottom wall. The space behind the face plate and between the bottom-most drawer and the bottom wall (like the space under the bottom wall) is not utilized.

Additionally, many of these prior tool chests often have a pull out work surface. Many times, these work surfaces are not used and simply occupy space that otherwise could be used for storage.

SUMMARY OF THE INVENTION

It is a general object of the invention to provide an improved tool chest which avoids the disadvantages of the prior tool chests while affording additional structural and operational advantages.

An important feature of the invention is the provision of a tool chest which is of a relatively simple and economical construction.

A further feature of the invention is the provision of a tool chest of the type set forth, which maximizes storage space.

Yet another feature of the invention is the provision of a tool chest of the type set forth which is flexible in use by providing a reversible combination tray/work surface which can be used as a work station or, if additional storage space is needed, can be reversed and used as a storage tray.

These and other features of the invention are attained by providing a tool chest including a housing having a top wall, a bottom wall and two substantially parallel side walls. Each side wall connects the top and bottom walls. The bottom wall has an interior surface facing the top wall and an exterior surface facing away from the top wall. The tool chest also includes a pair of legs connected to the exterior surface of the bottom wall for supporting the housing on a support surface, whereby the bottom wall is disposed above the support surface, and a tray slidably supported on the legs.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
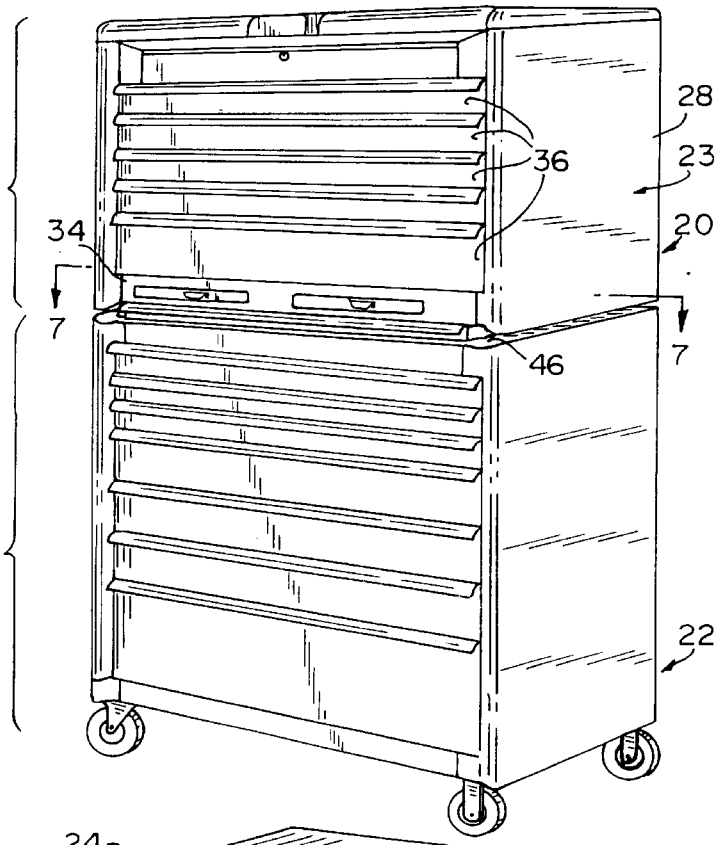
FIG. 1 is a perspective view of the tool chest of the present invention fully closed and disposed atop a roll cabinet illustrating the reversible combination tray/work surface in the storage mode.

Referring to FIGS. 1–3 and 7 of the drawings, a tool chest 20 is provided which lies atop a roll cabinet 22. The tool chest 20 includes a housing 23. The housing 23 has a top wall 24, two substantially parallel side walls 26, 28, a back wall 30 connected to the side walls 26, 28, a bottom wall 32 connected to the side walls 26, 28 and the back wall 30, and a face plate 34 connected to the side walls 26, 28 and the bottom wall 32. The top wall 24, side walls 26, 28, back wall 30, bottom wall 32, face plate 34, and the top wall 24 define an open cavity in which a plurality of drawers 36 are slidably housed in a known manner. As discussed more fully below, the face plate 34 has a pair of generally rectangular apertures 35 therethrough.

Figure 7:
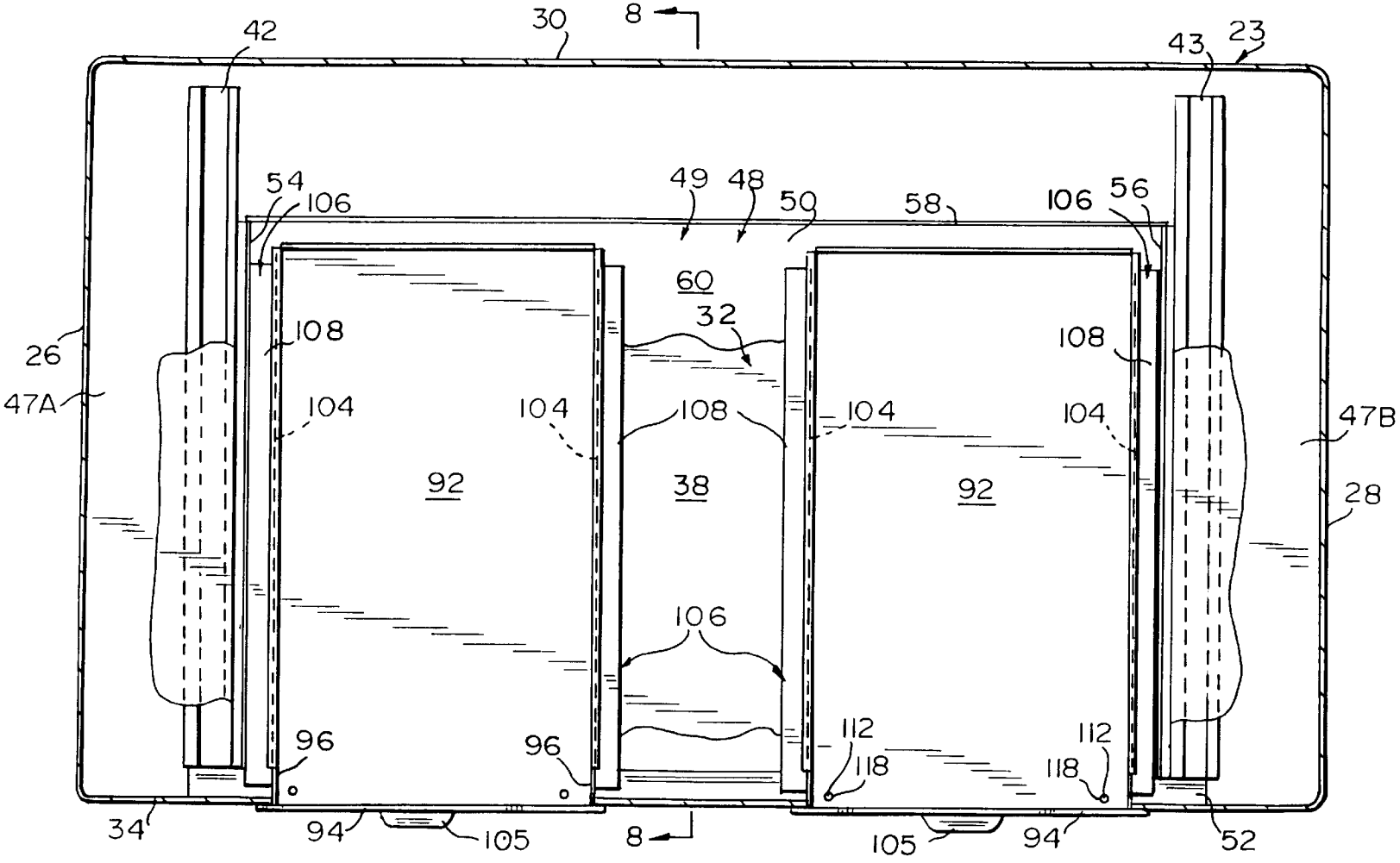
FIG. 7 is an enlarged, sectional view taken generally along line 7—7 of FIG. 1 with portions broken away.

The bottom wall 32 of the housing 23 has an interior surface 38 facing the top wall 24 and an exterior surface 40 facing away from the top wall 24. Attached to the exterior surface 40 are a pair of elongated U-shaped legs 42, 43. Each U-shaped leg 42, 43 is, as best seen in FIGS. 3 and 7, elongated in a direction substantially parallel to the side walls 26, 28 and to the bottom wall 32.

Figure 3:
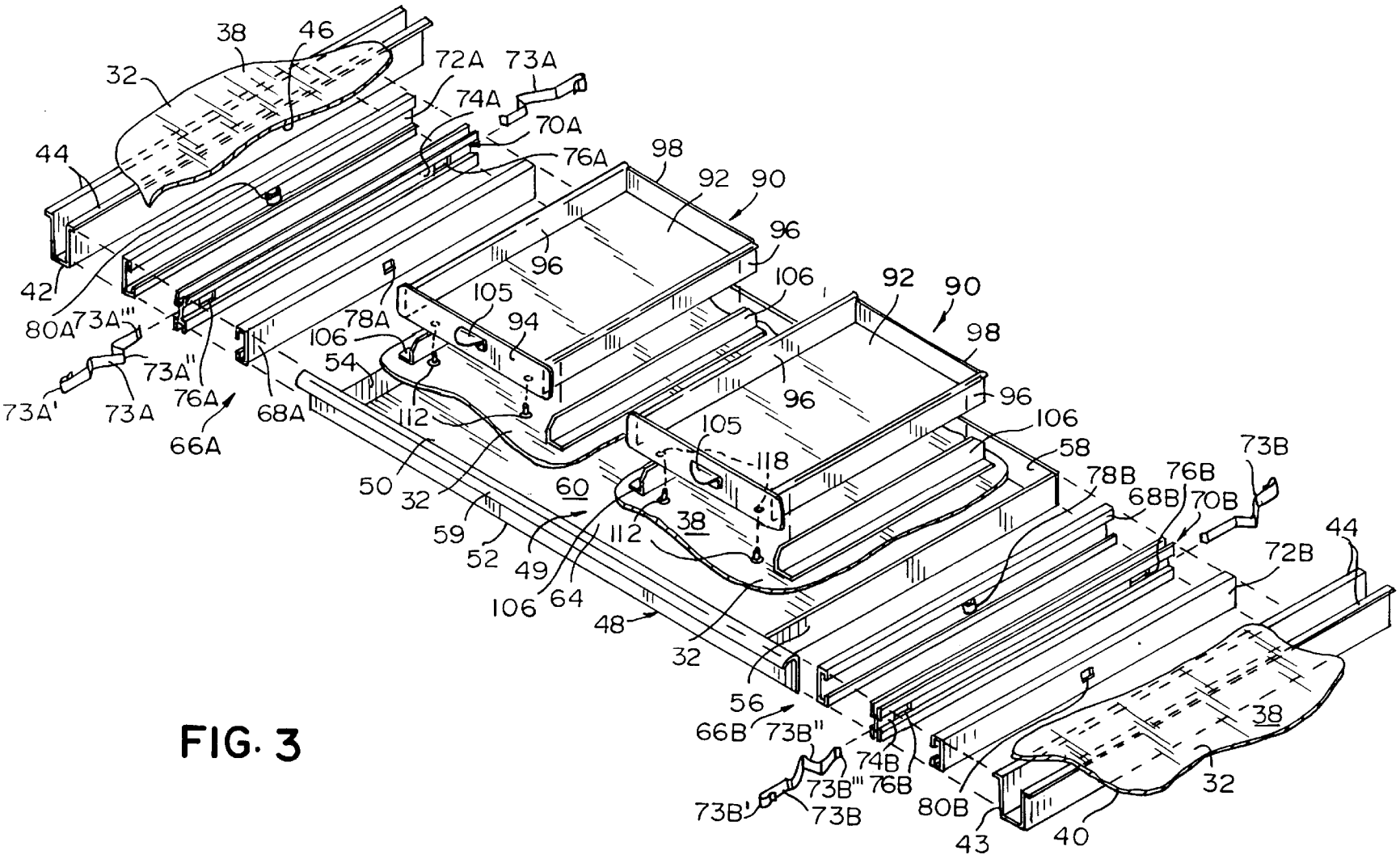
FIG. 3 is a fragmentary, exploded, perspective view of the lower portion of the tool chest of FIG. 1, illustrating the reversible combination tray/work surface (in the storage mode) and the two bottom tote drawers.

As seen best in FIG. 3, each U-shaped leg 42, 43 has a pair of flanges 44 welded, or otherwise connected, to the exterior surface 40 of the bottom wall 32. The U-shaped legs 42, 43 support the housing 23 on and above an underlying support surface 46 (FIGS. 9 and 13), such as the top of the roll cabinet 22. Since the bottom wall 32 is disposed above the support surface 46, two spaces 47A, 47B are provided under the bottom wall 32 respectively outward of the support legs 42 and 43. These spaces allow users to grasp the tool chest 20 under the bottom wall 32 to pick up and transport the tool chest 20 to a different location.

Figure 8:
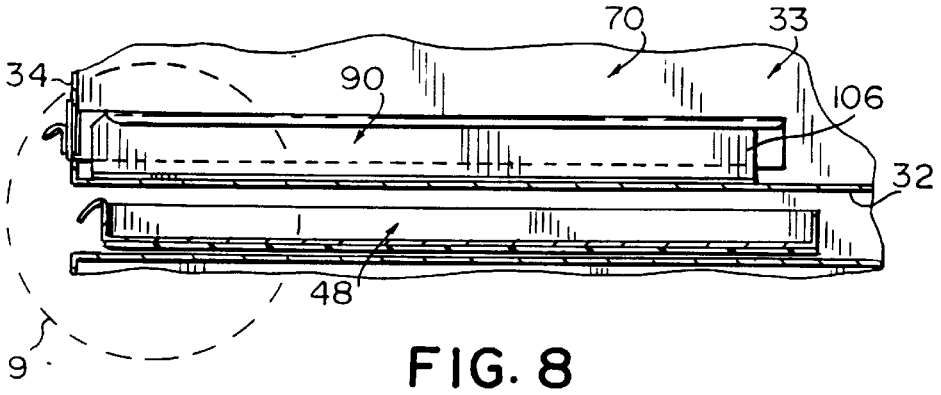
FIG. 8 is a fragmentary, sectional view taken generally along line 8—8 of FIG. 7.
Figure 9:
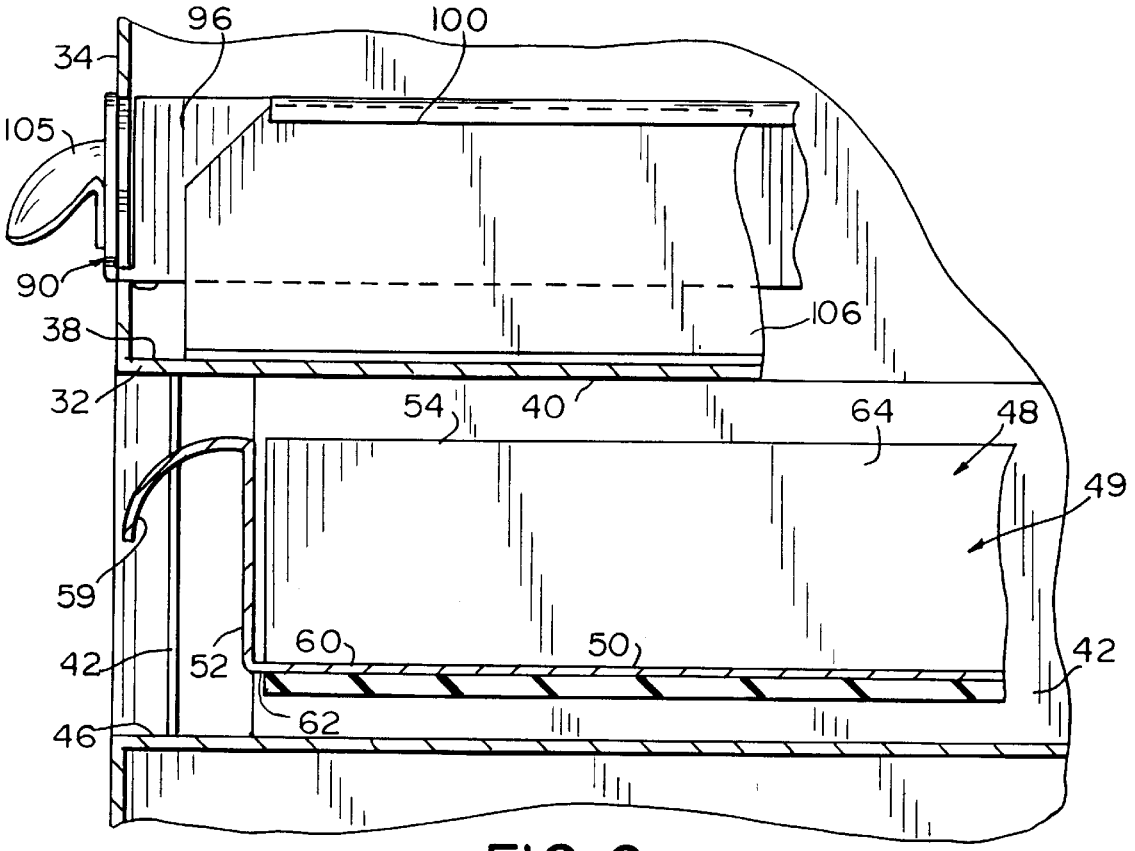
FIG. 9 is an enlarged, fragmentary sectional view of the circled portion of the tool chest of FIG. 8.

Referring now also to FIGS. 8 and 9, disposed between and slidably supported by the U-shaped legs 42, 43 is a combination tray/work surface 48, which has a body 49 including a bottom tray wall 50, a tray front wall 52, two substantially parallel tray side walls 54, 56 and a tray rear wall 58. Each of the tray front wall 52, the tray side walls 54, 56 and the tray rear wall 58 is integral with and substantially perpendicular to the bottom tray wall 50. Integral with the tray front wall 52 is an arcuate tray handle 59 for grasping by the user. Preferably, the body 49 is of one-piece construction.

The bottom tray wall 50 has an interior surface 60 and an exterior surface 62. The interior surface 60 of the bottom tray wall 50, the two tray side walls 54, 56 and the tray rear wall 58 form an open compartment 64.

Figure 4:
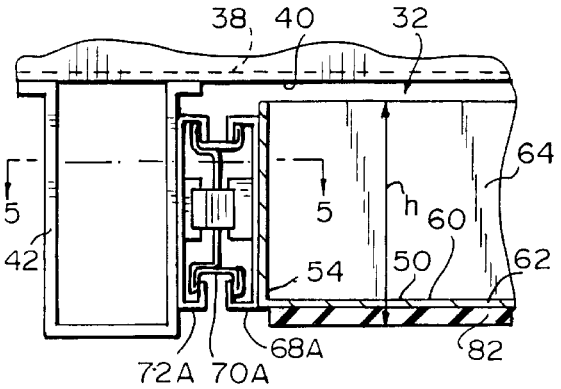
FIG. 4 is a further enlarged, fragmentary, sectional view taken generally along line 4—4 of FIG. 2, and showing a tray/work surface slide assembly.
Figure 5:
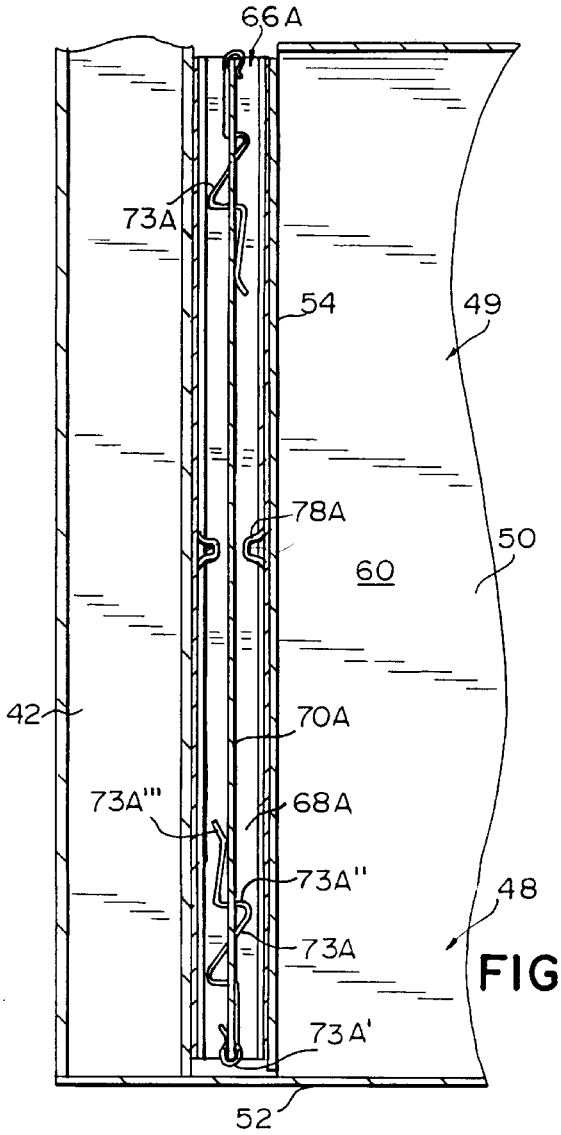
FIG. 5 is a fragmentary, sectional view taken generally along line 5—5 of FIG. 4.
Figure 6:
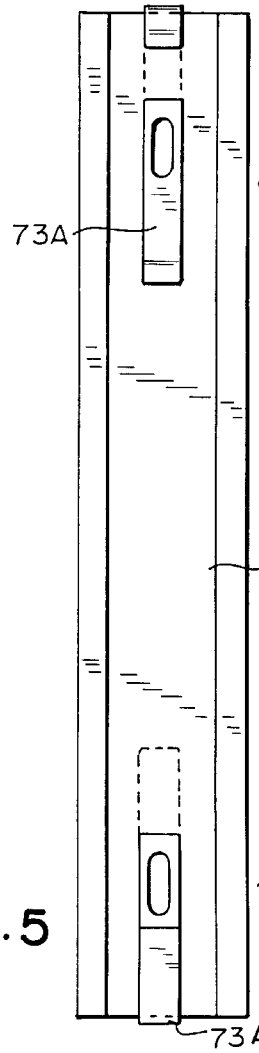
FIG. 6 is a side elevational view of the intermediate slide member of the slide assembly of FIG. 5.

Referring also to FIGS. 4–6, the combination tray/work surface 48 is slidably connected to the U-shaped legs 42, 43 by a pair of conventional drawer slide assemblies 66A, 66B. Drawer slide assemblies 66A, 66B respectively have tray side members 68A, 68B which are, respectively, connected to tray side walls 54, 56. Drawer slide assemblies 66A, 66B also respectively include intermediate members 70A, 70B and chest side members 72A, 72B which are, respectively, connected to the U-shaped legs 42, 43, all in a known manner.

Figure 2:
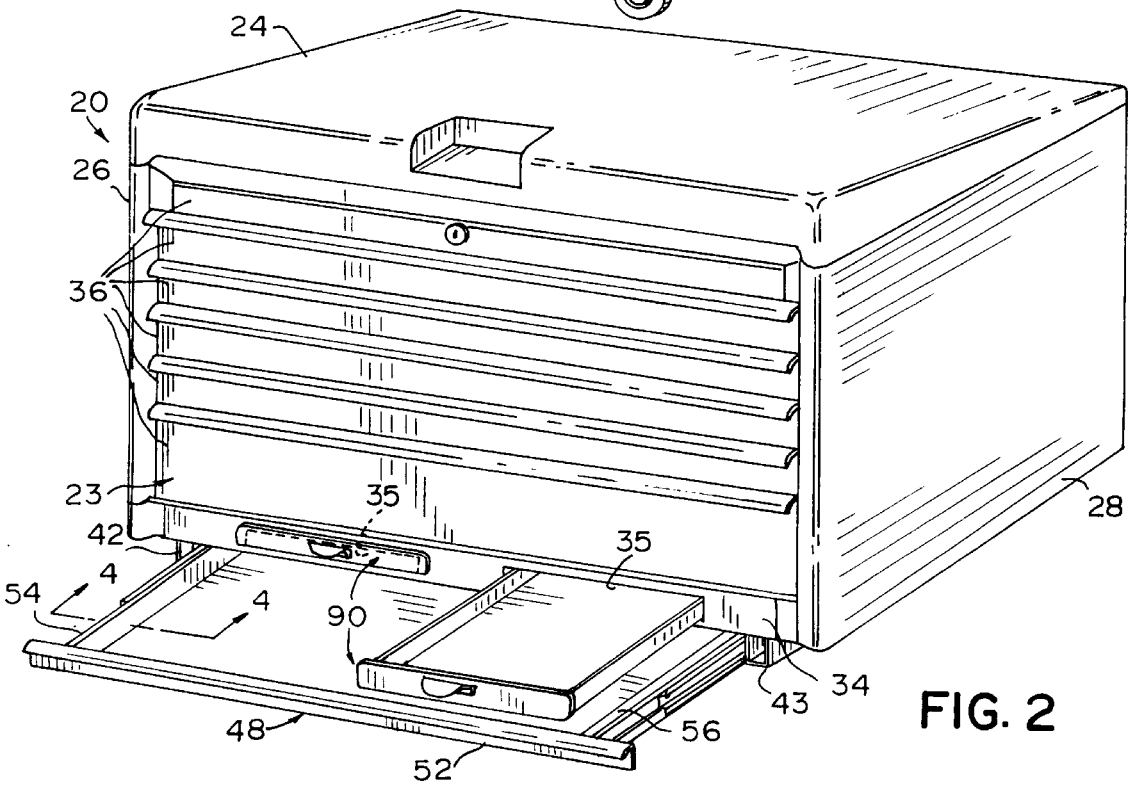
FIG. 2 is an enlarged perspective view of the tool chest of FIG. 1 with the tray/work surface and a bottom tote drawer open.
Figure 12:
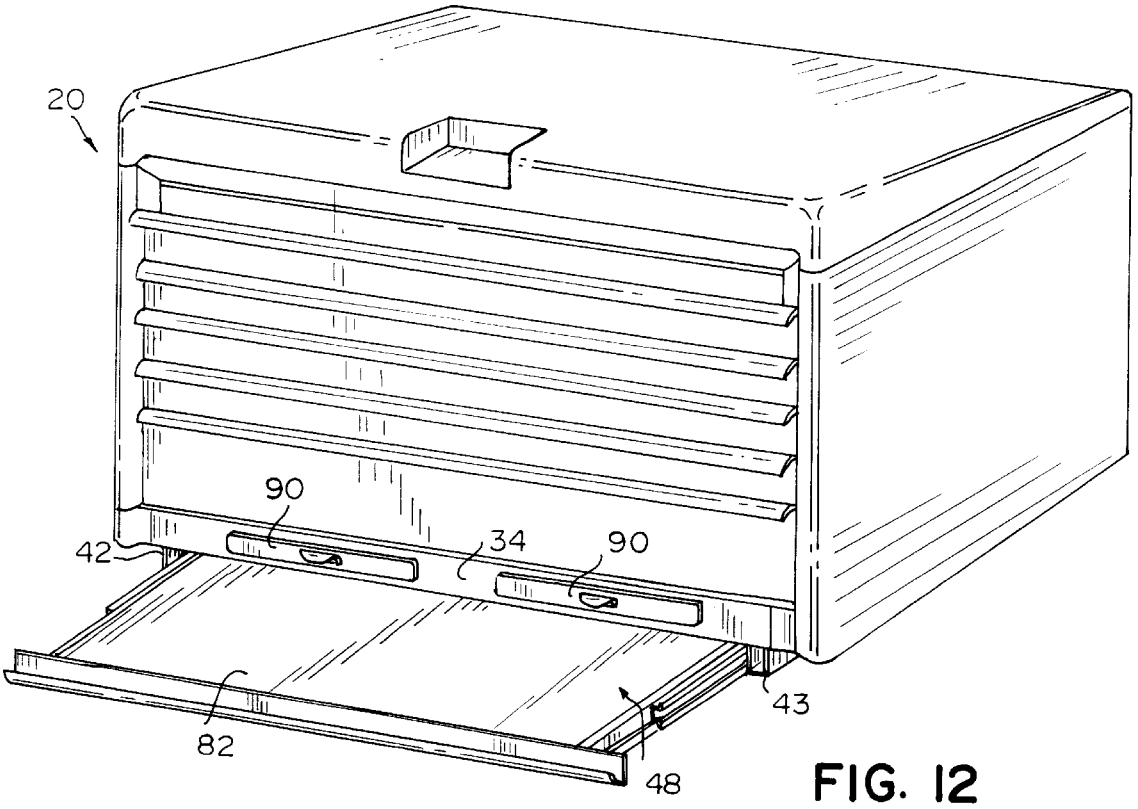
FIG. 12 is a perspective view similar to FIG. 2, with the reversible combination tray/work surface in the work mode and the tote drawer closed.

Intermediate members 70A, 70B respectively include pairs of spring clips 73A, 73B and bodies 74A, 74B. Bodies 74A, 74B respectively have pairs of apertures 76A, 76B, each of which apertures receives a portion of a spring clip 73A, 73B therethrough. Tray side members 68A, 68B, respectively, have stops 78A, 78B and chest side members 72A, 72B respectively have stops 80A, 80B (FIGS. 3 and 5). The drawer slide assemblies 66A, 66B allow the combination tray/work surface 48 to slide in a direction substantially parallel to side walls 26, 28 and into and out of the space defined by the exterior surface 62 of the bottom tray wall 50, the U-shaped legs 42, 43 and the support surface 46 (FIGS. 2 and 12). The stops 78A, 78B, 80A, 80B cooperate with the spring clips 73A, 73B to aid in limiting how far the combination tray/work surface 48 can be slid, all in a known manner. The spring clips 73A, 73B respectively have a clip end 73A', 73B', a stop surface 73A", 73B" and a prying end 73A'", 73B'".

The combination tray/work surface 48 has a storage mode and work mode. When the combination tray/work surface 48 is in the storage mode, as seen in FIGS. 1–5 and 7–9, the interior surface 60 of the bottom tray wall 50 faces the exterior surface 40 of the bottom wall 32 of the housing 23, so that items can be stored in the compartment 64 (FIG. 8).

Figure 13:
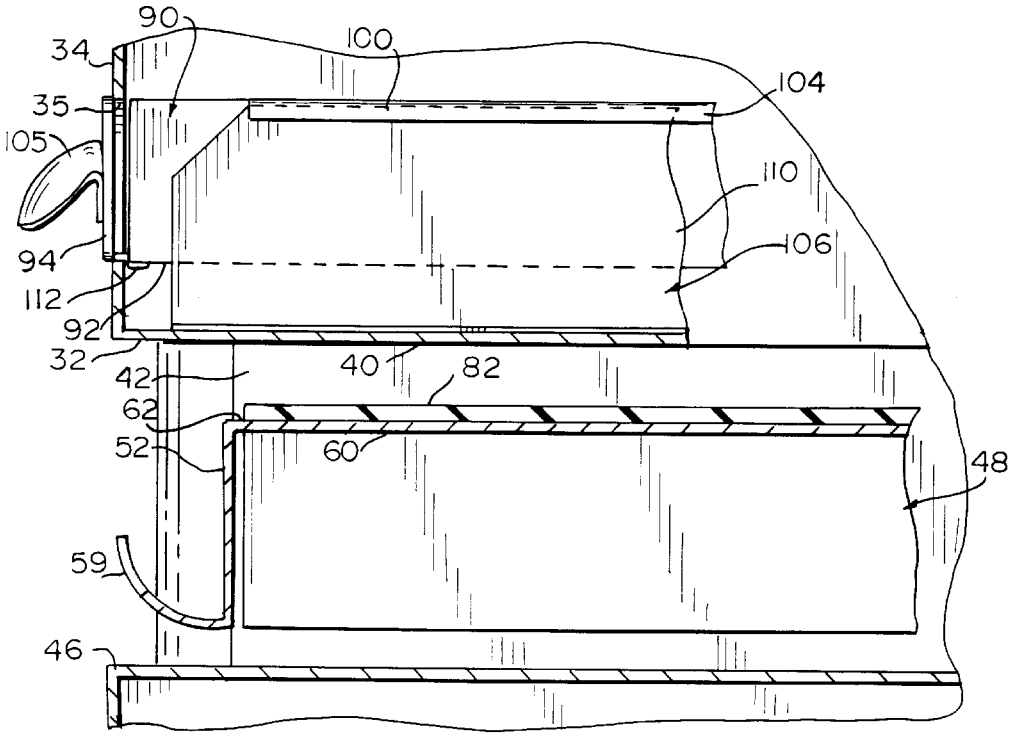
FIG. 13 is a side elevational view similar to FIG. 9 illustrating the combination tray/work surface in the work mode.

When it is desired to use the combination tray/work surface 48 in the work mode, as seen in FIGS. 12 and 13, the combination tray/work surface 48 is slid away from the back wall 30 as far as possible and the stops 78A, 78B respectively contact the stop surface 73A", 73B" of the respective spring clip 73A, 73B closest to the face plate 34. The prying ends 73A'" and 73B'" of these spring clips are then each manually pried away from the respective body 74A, 74B of respective intermediate member 70A, 70B thereby moving the stop surfaces 73A", 73B" out of the path of the stops 78A, 78B and allowing the combination tray/work surface 48 to be slid further away from the back wall 30 to disengage each tray side member 68A, 68B from the respective intermediate member 70A, 70B and disconnect the combination tray/work surface 48 from the U-shaped legs 42, 43. The combination tray/work surface 48 is then flipped over and the tray side member 68A is engaged with intermediate member 70B and tray side member 68B is engaged with intermediate member 70A. As seen in FIGS. 12 and 13, when the combination tray/work surface 48 is in the work mode, the exterior surface 62 faces the bottom wall 32 and can be used as a work surface.

Preferably, the exterior surface 62, as best seen in FIG. 9 and 13, has a work mat 82 attached to and covering most of its surface. The work mat 82 can be attached to the exterior surface 62 by adhesive or other means. The work mat 82 may be constructed of rubber or plastic and provides a surface with a higher coefficient of friction than the exterior surface 62, which is typically constructed of a metal. The work mat 82 thus aids in preventing tools, or other items, from slipping off the combination tray/work surface 48, as well as protecting the exterior surface 62.

To allow the combination tray/work surface 48 to be reversed from the storage mode to the work mode, or vice versa, there must be some clearance space between both the combination tray/work surface 48 and the bottom wall 32 of the housing 23 and between the combination tray/work surface 48 and the support surface 46. One way to achieve this needed clearance is by positioning the tray side members 68A, 68B of the slide assemblies 66A, 66B on the tray side walls 54, 56 so that they are disposed at the center of the height of "h" the combination tray/work surface 48, indicated by double arrow in FIG. 4.

Figure 10:
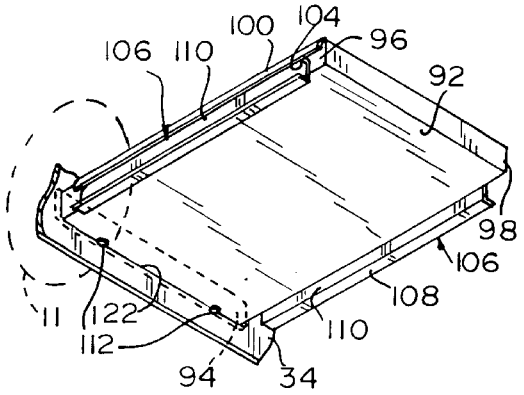
FIG. 10 is a fragmentary, bottom perspective view of one of the tote drawers in a closed position.
Figure 11:
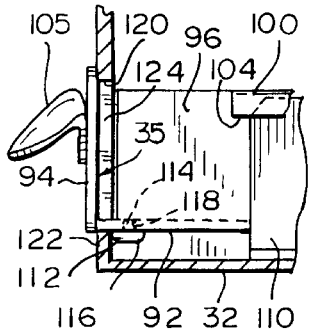
FIG. 11 is an enlarged, fragmentary, side elevational view, partially in section, of the circled portion of FIG. 10.

Referring also to FIGS. 10 and 11, the tool chest 20 also includes a pair of tote trays or tote drawers 90 located under drawers 36, which provide added storage. Each tote drawer 90 includes a bottom wall 92, a drawer front 94, two substantially parallel side walls 96 and a rear wall 98. The bottom wall 92, drawer front 94, side walls 96 and rear wall 98 are preferably of one-piece construction. Each side wall 96 has a lip 100 at its upper end that defines a channel 104. The tote drawer 90 can also include a handle 105 (FIGS. 3 and 13), spot-welded, or otherwise connected, to the drawer front 94.

Each of the tote drawers 90 is slidably supported on a pair of L-shaped drawer supports 106. Each L-shaped drawer support 106 has a horizontal portion 108 integral with a vertical portion 110. Each L-shaped drawer support 106 is spaced laterally inwardly from the side walls 26, 28 of the housing 23 and the horizontal portion 108 is connected to the interior surface 60 of the bottom wall 32 of the housing 23 by spot welding or other conventional means. Each lip 100 of a side wall 96 rests on a vertical portion 110 of a respective drawer support 106, so that a portion of the vertical portion 110 is disposed in a respective channel 104.

A portion of each tote drawer 90 is disposed through a respective aperture 35. Each drawer front 94 has a larger area than the respective aperture 35 it faces, whereby the upper end and the sides of each drawer front 94 overlap portions of the face plate 34 surrounding the respective aperture 35 to limit the sliding movement of each tote drawer 90 in the closing direction.

As best seen in FIGS. 10 and 11, each tote drawer 90 also include a pair of drawer stops 112 connected to its bottom wall 92. Each of the stops 112 has an upper cylindrical portion 114 integral with a larger diameter lower cylindrical portion 116. The stops 112 are typically constructed of a rubber or plastic. The upper cylindrical portions 114 are each disposed in apertures 118 in the bottom wall 92 and maintained thereby a friction fit. The lower cylindrical portion 116 lies below the bottom wall 92.

Each of the apertures 35 in the face plate 34 is defined by generally parallel upper and lower surfaces 120, 122 connected by substantially parallel side surfaces 124, 126. Each tote drawer 90 has a closed or locked position and an open position. In the locked position, as seen in FIGS. 9, 10, 11 and 13, the height of each side wall 96 of the tote drawer 90 is dimensioned so that when each lip 102 rests on a vertical portion 110 of the L-shaped drawer support 106, the lower cylindrical portion 116 of the stop 112 lies below the lower surface 122 of the respective aperture 35, whereby the tote drawer 90 is prevented from independently sliding outwardly away from the back wall 30 of the housing 23, to an open position (as seen with the right tote drawer 90 in FIG. 2).

To place a tote drawer 90 in an open position (FIG. 2), the tote drawer 90 must be first raised towards the top wall 24 and then be pulled outwardly so that both the side walls 96 and the stops 112 can pass together through an aperture 35.

To accommodate this passage, the distance between the upper surface 120 and the lower surface 122 of an aperture 35 is greater than the distance between the bottom of the lower cylindrical portion 116 of the stop 112 and the top of any side wall 96 of the tote drawer 90 disposed through the aperture 35.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A tool chest comprising:

a housing having a top wall, a bottom wall and two substantially parallel and planar side walls, each side wall connecting the top and bottom walls, the bottom wall having an interior surface facing the top wall and an exterior surface facing away from the top wall;

a plurality of drawers disposed in the hous4ng above the interior surface of the bottom wall;

a pair of legs fixed to and depending from the exterior surface of the bottom wall for supporting the housing on and the bottom wall above a support surface, each leg being disposed in-board of the planes of both side walls and having an inner portion; and a tray disposed below the exterior surface and slidably supported on the inner portions of the legs.

2. The chest of claim 1, wherein each of the legs is elongated in a direction substantially parallel to the side walls and the tray is slidable in a direction substantially parallel to the side walls.

3. The chest of claim 2, wherein each of the legs is elongated in a direction substantially parallel to the bottom wall and the tray is slidable in a direction substantially parallel to the bottom wall.

4. The chest of claim 1, wherein the tray includes a bottom tray wall having an interior tray surface and an exterior tray work surface, a tray front, a rear wall and a pair of tray side walls, each of the rear wall, tray side walls and the tray front being integral with and substantially perpendicular to the bottom tray wall, wherein the interior tray surface, the tray front, the rear wall and the tray side walls form an open compartment.

5. The chest of claim 4, wherein the tray is of one-piece construction.

6. The chest of claim 4, and further comprising a work mat connected to the exterior tray surface.

7. The chest of claim 4, wherein the tray is disposable in a work mode in which the exterior tray surface faces the exterior surface of the bottom wall, and a storage mode in which the interior tray surface faces the exterior surface of the bottom wall.

8. The chest of claim 7, wherein the tray has a height as measured in a direction perpendicular to the bottom wall, and the tray is supported on the legs by a pair of slide assemblies.

9. The chest of claim 8, wherein each slide assembly has a member connected to a respective tray sidewall, each member disposed substantially at the center of the height of the tray, whereby the tray can be supported on the slide assemblies in the work and storage modes.

10. The chest of claim 1, and further comprising a tote drawer, and a pair of tote drawer supports connected to the bottom wall, wherein the tote drawer is slideably supported on the tote drawer supports.

11. The chest of claim 10, wherein the tote drawer has a pair of tote drawer side walls and a tote drawer bottom wall connecting the tote drawer side walls, each of the tote drawer side walls having a lip defining a channel, wherein a portion of each tote drawer support is disposed in a respective channel.

12. A tool chest comprising:

a housing having a top wall, a bottom wall and two substantially parallel side walls, each side wall integrally connecting the top and bottom walls, the bottom wall having an interior surface facing the top wall and an exterior surface facing away from the top wall, the housing further having a face plate integral with the bottom wall and the side walls of the housing, the face plate being disposed above the bottom wall and having aperture upper and lower surfaces and a pair of aperture side surfaces each connecting the aperture upper and lower surfaces, the aperture surfaces defining an aperture for receiving a tote drawer;

a plurality of drawers disposed in the housing and above the face plate;

a pair of tote drawer supports, each tote drawer support connected to the interior surface of the bottom wall and spaced apart from each of the side walls; and a tote drawer disposed through the aperture and slidably supported on the tote drawer supports.

13. The chest of claim 12, wherein the tote drawer has a pair of tote drawer side walls and a tote drawer bottom wall connecting the tote drawer side walls, each of the tote drawer side walls having a lip defining a channel, wherein a portion of each lip rests on a respective tote drawer support whereby a portion of each tote drawer support is disposed in a respective channel.

14. The chest of claim 13, and further comprising a stop member connected to the tote drawer bottom wall and extending below the lower surface in a locked position, whereby when the tote drawer is attempted to be slid on the tote drawer supports to an open position, the stop member contacts the face plate below the lower aperture surface to limit movement of the tote drawer.

15. The chest of claim 13, wherein the tote drawer is of one-piece construction.

16. The chest of claim 12, and further comprising a pair of legs depending from the exterior surface of the bottom wall for supporting the housing on a support surface so that the bottom wall is disposed above the support surface, and a tray slidably supported on the legs.

17. The chest of claim 16, wherein each of the legs is elongated in a direction substantially parallel to the side walls and the tray is slidable in a direction substantially parallel to the side walls.

18. The chest of claim 16, wherein the tray includes a bottom tray wall having an interior tray surface and an exterior tray work surface, and four tray side walls integral with and substantially perpendicular to the bottom tray wall, the interior tray surface and the four tray side walls cooperating to form an open compartment.

19. The chest of claim 18, and further comprising a work mat connected to the exterior tray surface.

20. The chest of claim 16, wherein the tray is disposable in a work mode in which the exterior tray surface faces the exterior surface of the bottom wall, and a storage mode in which the interior tray surface faces the exterior surface of the bottom wall.

21. The chest of claim 12, and further comprising a pair of legs depending from the exterior surface of the bottom wall for supporting the housing on a support surface so that the bottom wall is disposed above the support surface.

* * * * *